US011384545B2

(12) United States Patent
Schluter

(10) Patent No.: US 11,384,545 B2
(45) Date of Patent: Jul. 12, 2022

(54) PROFILE SYSTEM FOR INTERSECTING JOINTS

(71) Applicant: Schluter Systems L.P., Plattsburgh, NY (US)

(72) Inventor: Werner Schluter, Iserlohn (DE)

(73) Assignee: Schluter Systems L.P., Plattsburgh, NY (US)

( * ) Notice: Subject to any disclaimer, the term of this patent is extended or adjusted under 35 U.S.C. 154(b) by 5 days.

(21) Appl. No.: 17/147,006

(22) Filed: Jan. 12, 2021

(65) Prior Publication Data

US 2021/0230887 A1 Jul. 29, 2021

(30) Foreign Application Priority Data

Jan. 23, 2020 (DE) ..... 202020100337.2

(51) Int. Cl.
*E04F 19/00* (2006.01)
*E04F 19/06* (2006.01)

(52) U.S. Cl.
CPC ..... *E04F 19/061* (2013.01)

(58) Field of Classification Search
CPC . E04F 19/061; E04F 19/064; E04F 2013/063; E04F 13/06
USPC ..... 52/717.06
See application file for complete search history.

(56) References Cited

U.S. PATENT DOCUMENTS

| | | | | |
|---|---|---|---|---|
| 6,591,575 | B2 * | 7/2003 | Benedettini | E04F 19/061 52/287.1 |
| 9,482,010 | B2 * | 11/2016 | Kartler | E04F 19/022 |
| 2008/0083179 | A1 * | 4/2008 | Riggs | E04F 13/06 52/287.1 |
| 2010/0218444 | A1 * | 9/2010 | Wambaugh | E04F 13/06 52/255 |
| 2017/0071415 | A1 * | 3/2017 | Rosko | E04F 13/185 |
| 2018/0334813 | A1 * | 11/2018 | Schluter | E04F 19/061 |

* cited by examiner

*Primary Examiner* — Patrick J Maestri
(74) *Attorney, Agent, or Firm* — Jason Jones

(57) ABSTRACT

A profile system includes elongate profiles (2) for terminating installed tiles with a uniform, substantially L-shaped cross-section comprising a fastening leg (5) for fastening to a substrate and forming a bearing surface. An adjoining, substantially perpendicular, boundary leg (6) forms a contact surface for the tiles and each of the front ends (12) of the boundary leg forms a contact surface provided with a receiving opening (13) for receiving a connecting element (4). At least one corner connecting piece (3) is configured to visually connect the front ends (12) of the boundary legs of three profiles (2). At least two connecting elements (4) are configured so that one exposed end is inserted into the receiving opening (13) of a profile (2) for terminating installed tiles and an other exposed end is inserted into the receiving recess (24) of a corner connecting piece (3).

14 Claims, 17 Drawing Sheets

PROFILE SYSTEM FOR INTERSECTING JOINTS

PRIORITY CLAIM

Priority is claimed of and to German Patent Application Serial No. DE 20 2020 100 337.2, filed Jan. 23, 2020, which is hereby incorporated herein by reference in its entirety.

BACKGROUND OF THE INVENTION

Field of the Invention

The present invention relates to a profile system for use in intersecting joints where two or more planes of veneer material meet.

SUMMARY OF THE INVENTION

In accordance with one aspect of the technology, a profile system is provided including elongate profiles for terminating installed tiles with a uniform, substantially L-shaped cross-section including a fastening leg for fastening to a substrate and forming a bearing surface provided with through openings. An adjoining, substantially perpendicular, boundary leg is included, wherein the outer longitudinal side of the boundary leg faces away from the fastening leg and the top side of the boundary leg forms visible surfaces. The inner longitudinal side of the boundary leg faces towards the fastening leg and forms a contact surface for the tiles. Each of the front ends of the boundary leg forms a contact surface provided with a receiving opening for receiving a connecting element. At least one corner connecting piece is configured to visually connect the front ends of the boundary legs of three profiles arranged perpendicular to each other for terminating installed tiles. The fastening legs comprise an outer main side of the corner connecting piece, which forms a visible surface, an inner main side of the corner connecting piece opposite thereto, which forms a contact surface for the tiles, two adjacently arranged front ends of the corner connecting piece, each of which forms a contact surface provided with a receiving recess for receiving a connecting element, and two further front ends of the corner connecting piece which form visible edges. The contours of the outer main side of the corner connecting piece, that of the front ends of the corner piece forming the visible surfaces and that of the corner area connecting these front ends of the corner piece and the main side of the corner connecting piece to each other are adapted to the respective contours of the outer longitudinal sides of the boundary leg and the top sides of the boundary legs of the three profiles for terminating installed tiles connected to each other via a corner connecting piece such that the profiles are mutually aligned in a flush manner when installed. At least two connecting elements are configured so that one exposed end is inserted into the receiving opening of a profile for terminating installed tiles and an other exposed end is inserted into the receiving recess of a corner connecting piece.

In accordance with another aspect of the technology, a profile system is provided that includes elongate profiles for terminating installed tiles with a uniform, substantially L-shaped cross-section including a fastening leg for fastening to a substrate and forming a bearing surface provided with through openings, and including an adjoining, substantially perpendicular, boundary leg. An outer longitudinal side of the boundary leg faces away from the fastening leg, and a top side of the boundary leg forms visible surfaces.

The boundary leg is provided with a receiving opening for receiving a connecting element. At least one corner connecting piece is configured to visually connect the front ends of the boundary legs of three profiles arranged perpendicular to each other for terminating installed tiles. The corner connecting piece can be provided with a receiving recess for receiving a connecting element. At least two connecting elements can be configured so that one exposed end is inserted into the receiving opening of a profile for terminating installed tiles and an other exposed end is inserted into the receiving recess of a corner connecting piece.

BRIEF DESCRIPTION OF THE DRAWINGS

The same reference numbers relate hereafter to identical or similar components or component ranges.

DETAILED DESCRIPTION

Figure 1:
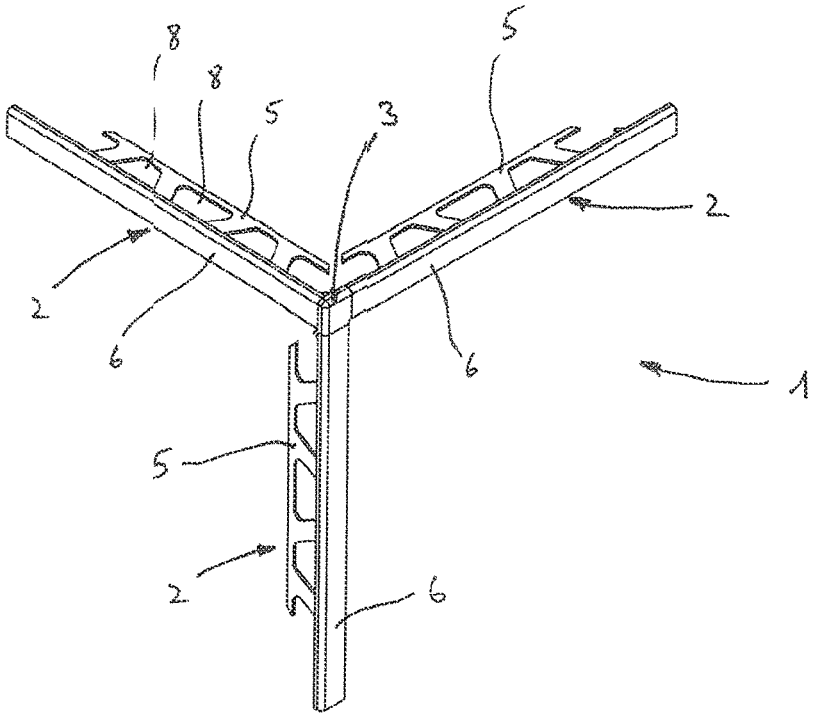
FIG. 1 shows a perspective view of a profile system according to an embodiment of the present technology when installed.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a profile" can include one or more of such pieces, if the context dictates.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure. Generally, directional terms used in this application, such as "top" or "bottom" refer to the installed state. The formulations "substantially vertical" and "substantially horizontal" are to be construed such that the main extension direction is vertical and horizontal, respectively.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present technology relates generally to a profile system comprising elongate, identically configured profiles for terminating installed tiles with a uniform, substantially L-shaped cross-section comprising a fastening leg for fastening to a substrate and forming a bearing surface provided with through openings, and comprising an adjoining, substantially perpendicular, boundary leg, wherein the outer longitudinal side of the boundary leg facing away from the fastening leg and the top side of the boundary leg form visible surfaces, the inner longitudinal side of the boundary leg facing towards the fastening leg forms a contact surface for the tiles and each of the front ends of the boundary legs forms a contact surface provided with an opening for receiving a connecting element.

Profiles of the type mentioned in the introduction for terminating installed tiles are used to terminate tile coverings laid in thin-bed mortar at the end of the covering or to terminate tile coverings in the area where they meet, thus forming a visual termination of the tile coverings. In addition, they protect the front ends of the tiles against damage. S used herein, the term "tiles" is understood in the context of the present application as a generic term for plate-shaped covering materials made from ceramic, natural stone or artificial stone. The term "thin-bed mortar" defines any type of adhesive and/or tile adhesive which can be used to lay tiles using what is known as the thin-bed method.

When laying a profile for terminating installed tiles, the fastening leg is embedded between a tile and the substrate in a thin-bed mortar which is used to fix the tile in place, wherein the thin-bed mortar penetrates the through openings of the fastening leg. In this way, the profile for terminating installed tiles is held securely in place on the substrate once the thin-bed mortar has cured. The boundary leg, the width of which is adapted to the thickness of the tiles, delimits and covers the front ends of the adjoining tiles. It is positioned such that a joint of a desired width which can subsequently be filled with jointing mortar remains between the boundary leg and the front ends of the adjoining tiles.

Profiles for terminating installed tiles, produced as extruded profiles, of the type mentioned in the introduction consisting of a fastening leg and a boundary leg with different material thicknesses are sold by Schlüter-Systems KG, for example, under the product designations "Schlüter-SCHIENE" or "Schlüter-Jolly".

Profiles for terminating installed tiles are generally easy to process. However, problems arise when laying profiles for terminating installed tiles in the area of external angles where three room surfaces meet. In this case, three profiles for terminating installed tiles must be mitred and then laid so that they abut each other, which in most cases produces a visually unconvincing result, even with good workmanship.

Based on this prior art, the aim of the present invention is to create an alternative profile system of the type mentioned in the introduction.

To achieve this aim, the present invention provides a profile system comprising elongate, identically configured profiles for terminating installed tiles with a uniform, substantially L-shaped cross-section comprising a fastening leg for fastening to a substrate and forming a bearing surface provided with through openings, and comprising an adjoining, substantially perpendicular, boundary leg, wherein the outer longitudinal side of the boundary leg facing away from the fastening leg and the top side of the boundary leg form visible surfaces, the inner longitudinal side of the boundary leg facing towards the fastening leg forms a contact surface for the tiles and each of the front ends of the boundary legs forms a contact surface provided with an opening for receiving a connecting element; at least one corner connecting piece which is configured to visually connect the front ends of the boundary legs of three profiles arranged perpendicular to each other for terminating installed tiles, the fastening legs of which profiles are mitred, comprising an outer main side of the corner connecting piece, which forms a visible surface, an inner main side of the corner connecting piece opposite thereto, which preferably forms a contact surface for the tiles, two adjacently arranged front ends of the corner connecting piece, each of which forms a contact surface provided with a receiving recess for receiving a connecting element, and two further front ends of the corner connecting piece which form visible edges, wherein the contours of the outer main side of the corner connecting piece, that of the front ends of the corner connecting piece forming the visible surfaces and of the corner area connecting these front ends of the corner connecting piece and the main side of the corner connecting piece to each other are adapted to the respective contours of the outer longitudinal sides of the boundary legs and the top sides of the boundary legs of the three profiles for terminating installed tiles connected to each other via a corner connecting piece such that they are mutually aligned in a flush manner when installed; and at least two connecting elements designed in the form of a pin, which are configured such that one exposed end is inserted into the receiving opening of a profile for terminating installed tiles and the other exposed end is inserted into the receiving recess of a corner connecting piece.

When installing three profiles for terminating installed tiles in a corner of a room projecting outwards which is formed by three room surfaces each extending perpendicular relative to each other, the fastening legs of the profiles for terminating installed tiles are mitred at the joint end as a first step. In a second step, two of the three profiles for terminating installed tiles are then connected to each other via the corner connecting piece using the two connecting elements such that the corresponding front ends of the boundary legs lie flush against the front ends of the corner connecting piece forming the contact surfaces, and are fixed in place using a thin-bed mortar along the edges of the corresponding room surfaces. Each connecting element is arranged such that it is received both in a receiving opening of a profile for terminating installed tiles and in one of the two receiving recesses of the corner connecting piece. The interim result attained on completion of the second step are two profiles for terminating installed tiles connected to each other via the corner connecting piece and fastened to the corresponding room surfaces, the outer longitudinal sides of the boundary legs of which are each positioned flush relative to the outer main surface of the corner connecting piece and the top sides of the boundary legs of which are each positioned flush relative to the corresponding front end of the corner connecting piece. In a subsequent third step, the third profile for terminating installed tiles is positioned such that it lies against the inner main side of the corner connecting piece and the outer longitudinal side of its boundary leg forms a flush termination with the adjoining front end of the corner connecting piece, whereupon the second profile for terminating installed tiles is also fixed in place using thin-bed mortar along the edge of the corresponding room surface.

A material advantage of the profile system according to the invention consists in the fact that visually very attractive joint areas of three profiles for terminating installed tiles in any given case can be produced quickly, easily and affordably.

In accordance with an embodiment of the present embodiment, the profiles for terminating tiles are configured integrally and in particular are made from metal, for example aluminium or stainless steel, or from plastic.

The profiles for terminating tiles are advantageously configured either as extruded profiles or as bending profiles.

The receiving openings are preferably substantially round in shape, and in particular are shaped in the form of an arc open on one side or at least partially configured in the shape of a curve or arc, resulting in a simple structure of the boundary leg.

The bottom side of the fastening leg advantageously protrudes downwards relative to a lower edge of the outer longitudinal side of the boundary leg, thus producing a lower jointing mortar receiving area for creating a joint with a predetermined visible width in the lower area of the boundary leg, wherein the jointing mortar receiving area can be provided with at least one undercut. Thanks to such a joint, a visually very attractive appearance is achieved. The jointing mortar can grip to an undercut. In the event that the profile for terminating installed tiles is produced as a bending profile, the fastening leg and boundary leg can be connected to each other via a transition leg such that the bottom side of the fastening leg protrudes downwards relative to a lower edge of the outer longitudinal side of the boundary leg. Undercuts can then be created in the form of slits or through openings extending through the transition leg.

Alternatively or additionally, the contact surface formed by the inner longitudinal side of the boundary leg advantageously protrudes inwards relative to an inward-facing edge of the upper side of the boundary leg, thus producing an upper jointing mortar receiving area for forming a joint with a predetermined visible width in the upper area of the boundary leg, wherein the jointing mortar area is provided with an undercut.

The visible joint widths are preferably matched to each other, thus creating an extremely uniform appearance.

In accordance with an embodiment of the present invention, each corner connecting piece is configured such that, when two profiles for terminating installed tiles are installed, the visible joints defined by the boundary legs of these profiles are mutually aligned without interruption by the corner connecting piece, in particular with a constant joint width, thereby also contributing to a visually extremely attractive appearance. To allow for an alignment of the bottom visible joint, a recess can be created in, for example, the corner area of the outer main surface of the corner connecting piece between the two front ends of the corner connecting piece forming contact surfaces, the edge of which recess sits flush against the respective lower edge of the outer longitudinal sides of the boundary leg. To allow for the alignment of the upper visible joint, the inner main surface of the corner connecting piece can be created in the form of a substantially cuboid projection in the corner area between the two front ends of the corner connecting piece forming contact surfaces, which preferably forms a flush termination with the base of the upper jointing mortar receiving area.

The corner connecting pieces are preferably made from the same material as the profiles for terminating installed tiles, thus achieving a uniform appearance.

The connecting elements are advantageously configured as female pins with a slit, thereby achieving a firm hold as soon as they are inserted in the corresponding receiving openings and receiving recesses.

The connecting elements can preferably be made from spring steel.

Figure 2:
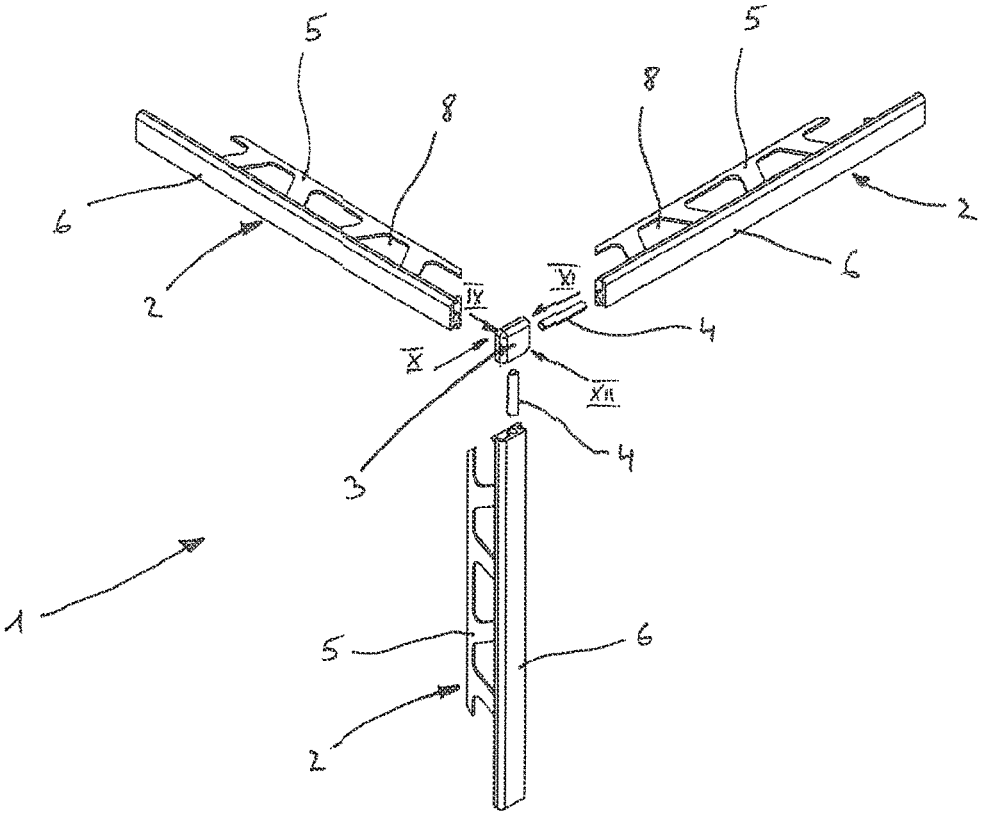
FIG. 2 shows an exploded view of the profile system shown in FIG. 1.
Figure 3:
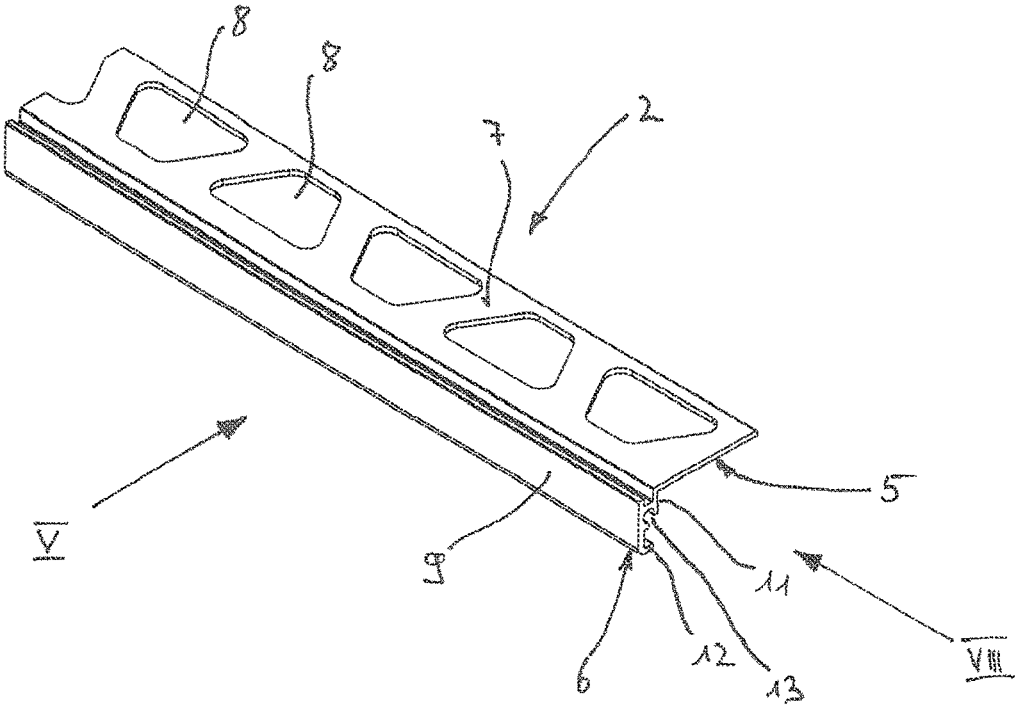
FIG. 3 shows a perspective view of a profile for terminating installed tiles from the profile system shown in FIG. 1.
Figure 4:
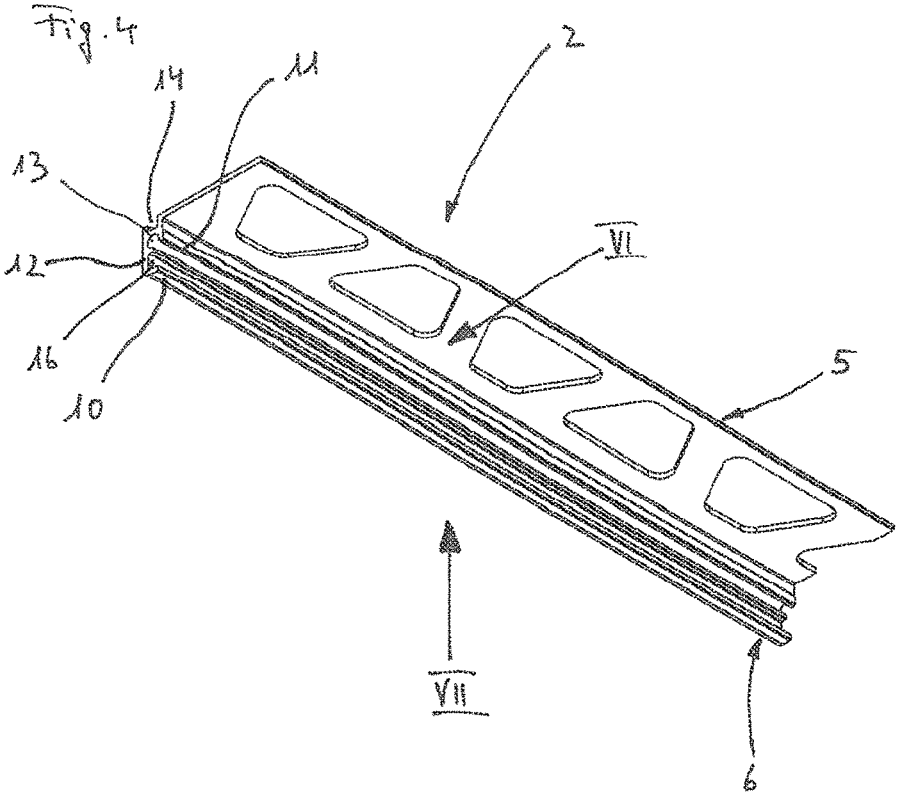
FIG. 4 shows a further perspective view of the profile for terminating installed tiles.
Figure 5:
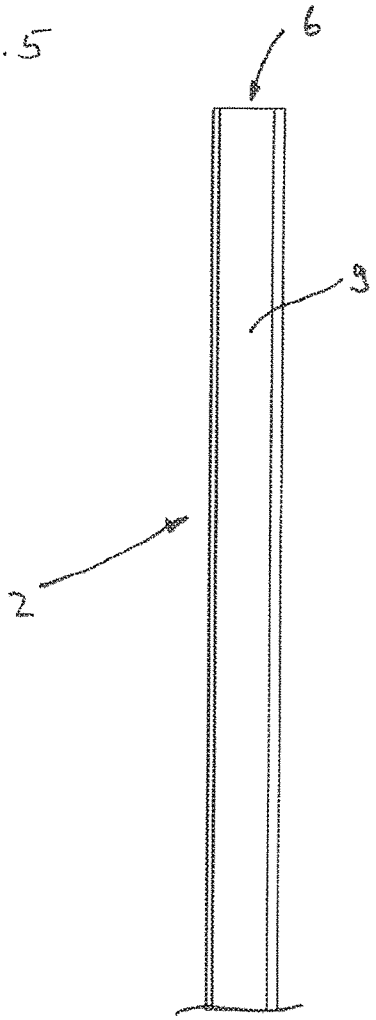
FIG. 5 shows a view of the profile for terminating installed tiles as seen in the direction of arrow V in FIG. 3.
Figure 6:
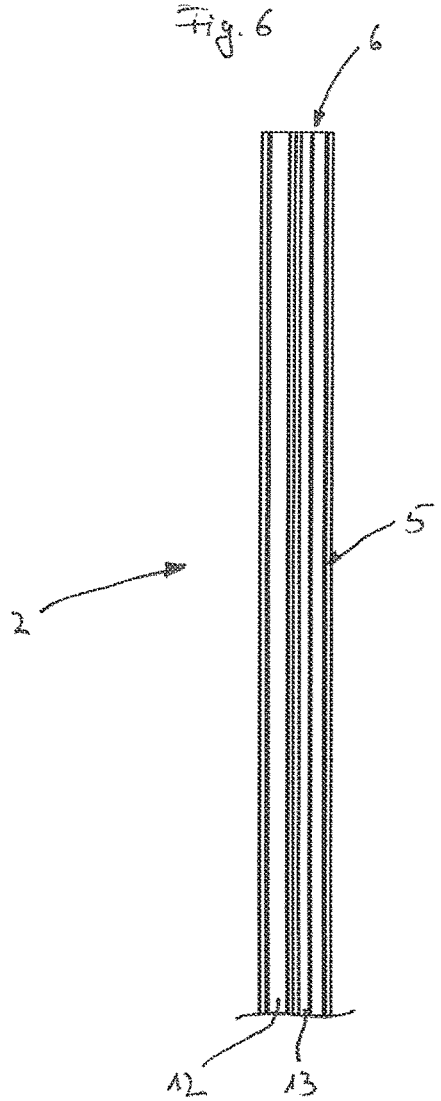
FIG. 6 shows a view of the profile for terminating installed tiles as seen in the direction of arrow VI in FIG. 4.
Figure 7:
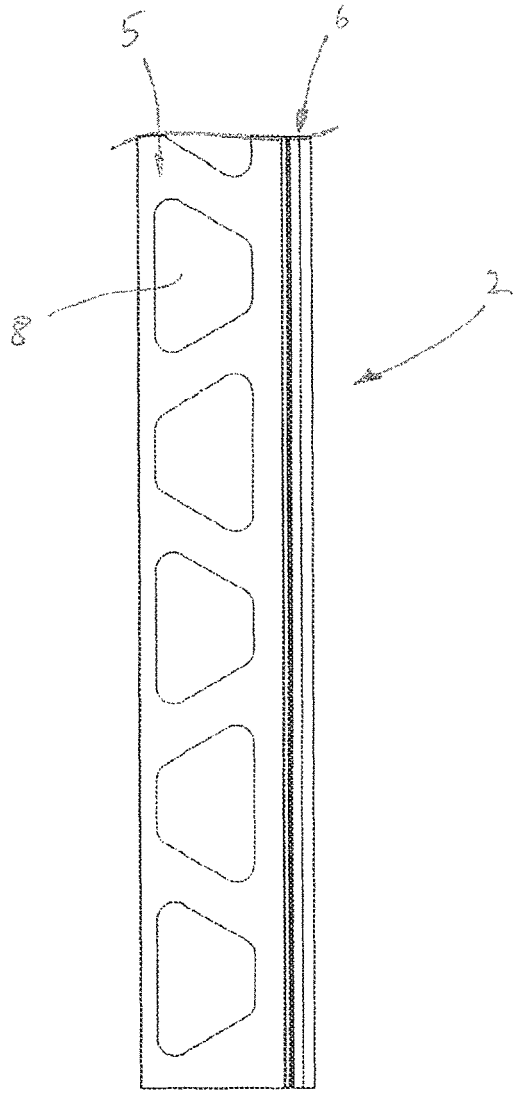
FIG. 7 shows a view of the profile for terminating installed tiles as seen in the direction of arrow VII in FIG. 4.
Figure 8:
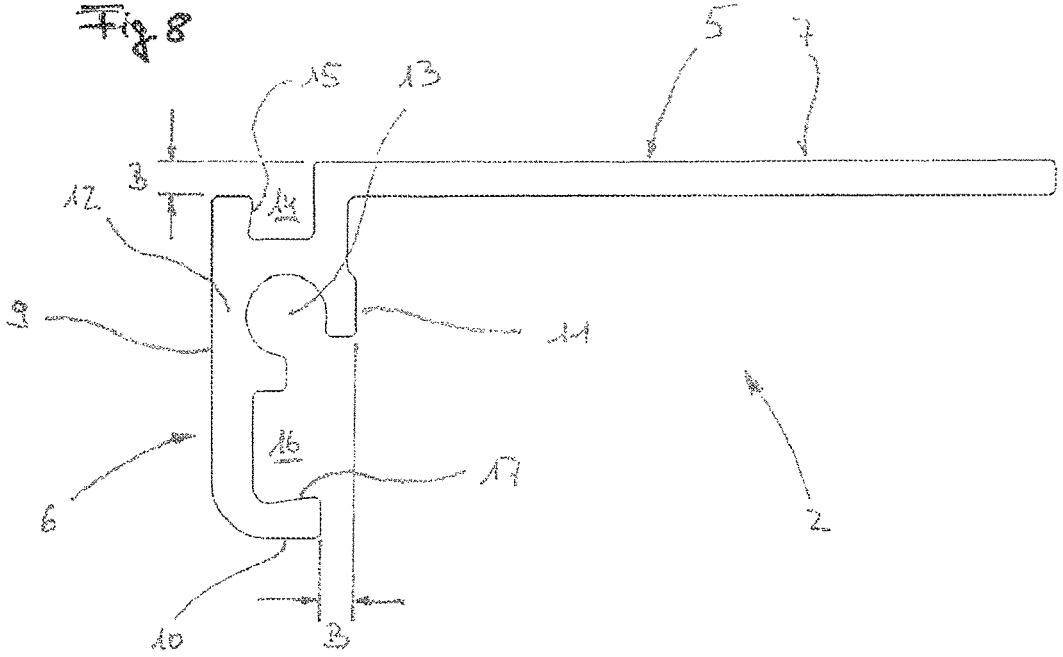
FIG. 8 shows a close-up view of the profile for terminating installed tiles as seen in the direction of arrow VIII in FIG. 3.
Figure 9:
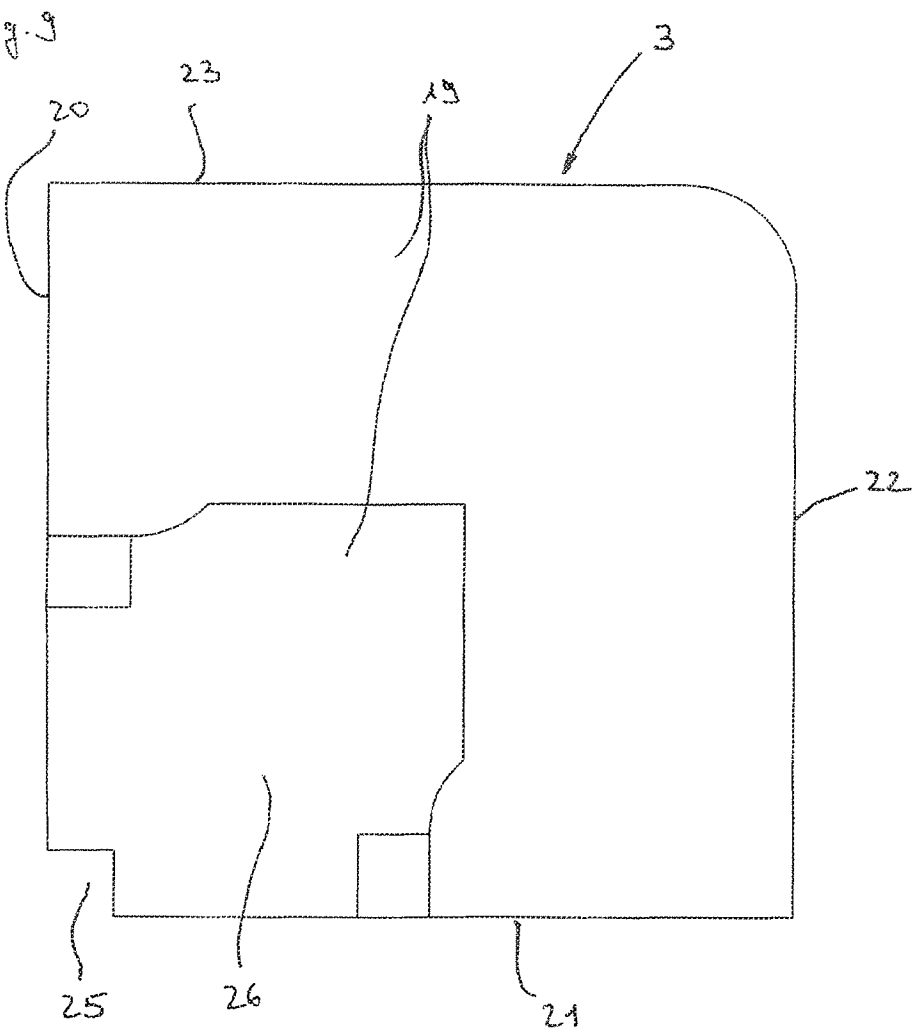
FIG. 9 shows a close-up view of a corner connecting piece of the profile system as seen in the direction of arrow IX in FIG. 2.
Figure 10:
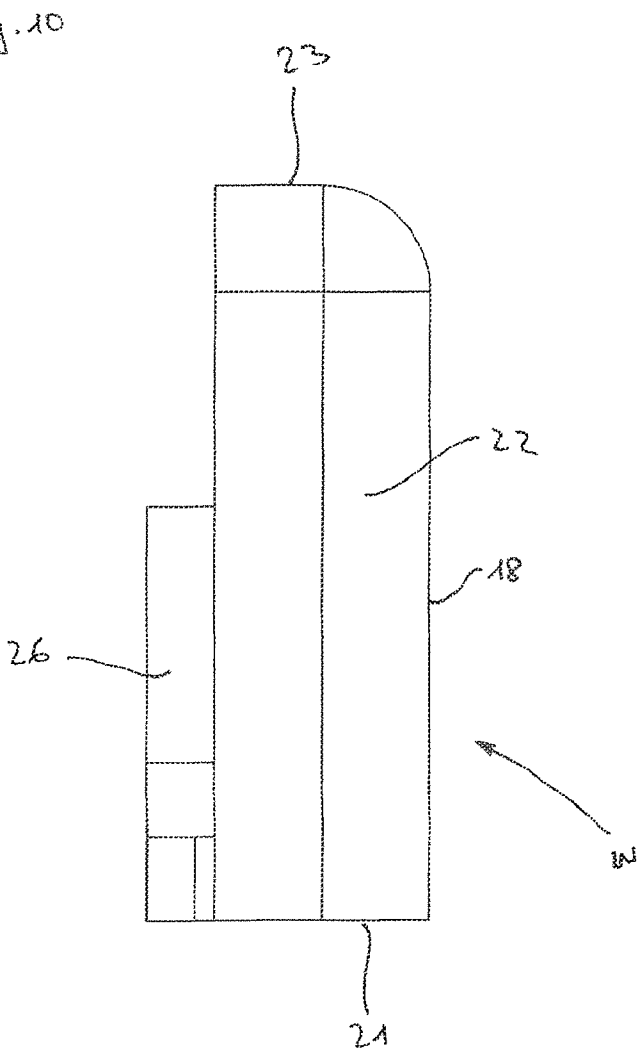
FIG. 10 shows a view of the corner connecting piece as seen in the direction of arrow X in FIG. 2.
Figure 12:
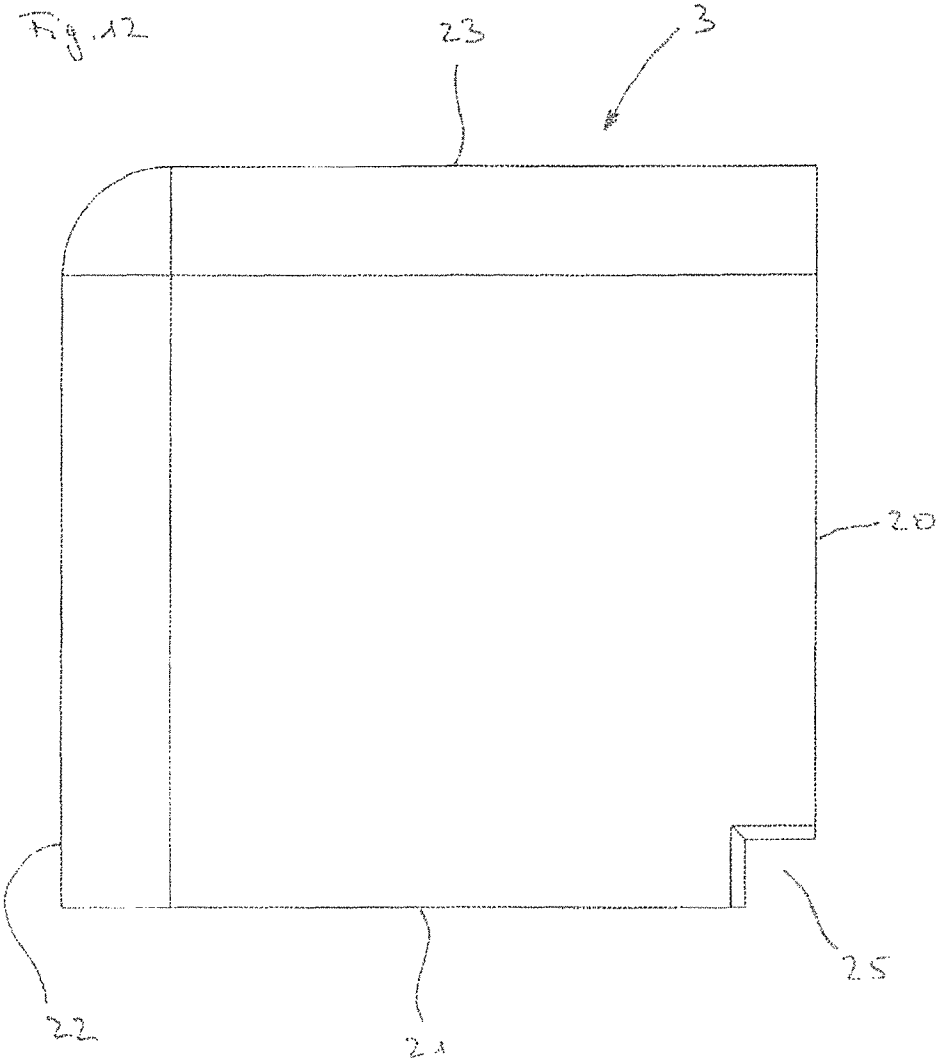
FIG. 12 shows a view of the corner connecting piece as seen in the direction of arrow XII in FIG. 2.
Figure 11:
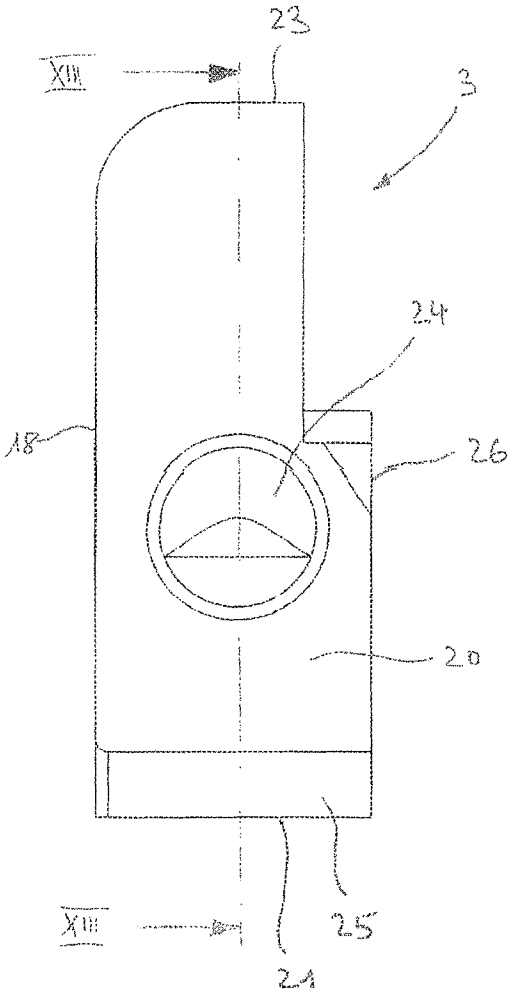
FIG. 11 shows a view of the corner connecting piece as seen in the direction of arrow XI in FIG. 2.
Figure 13:
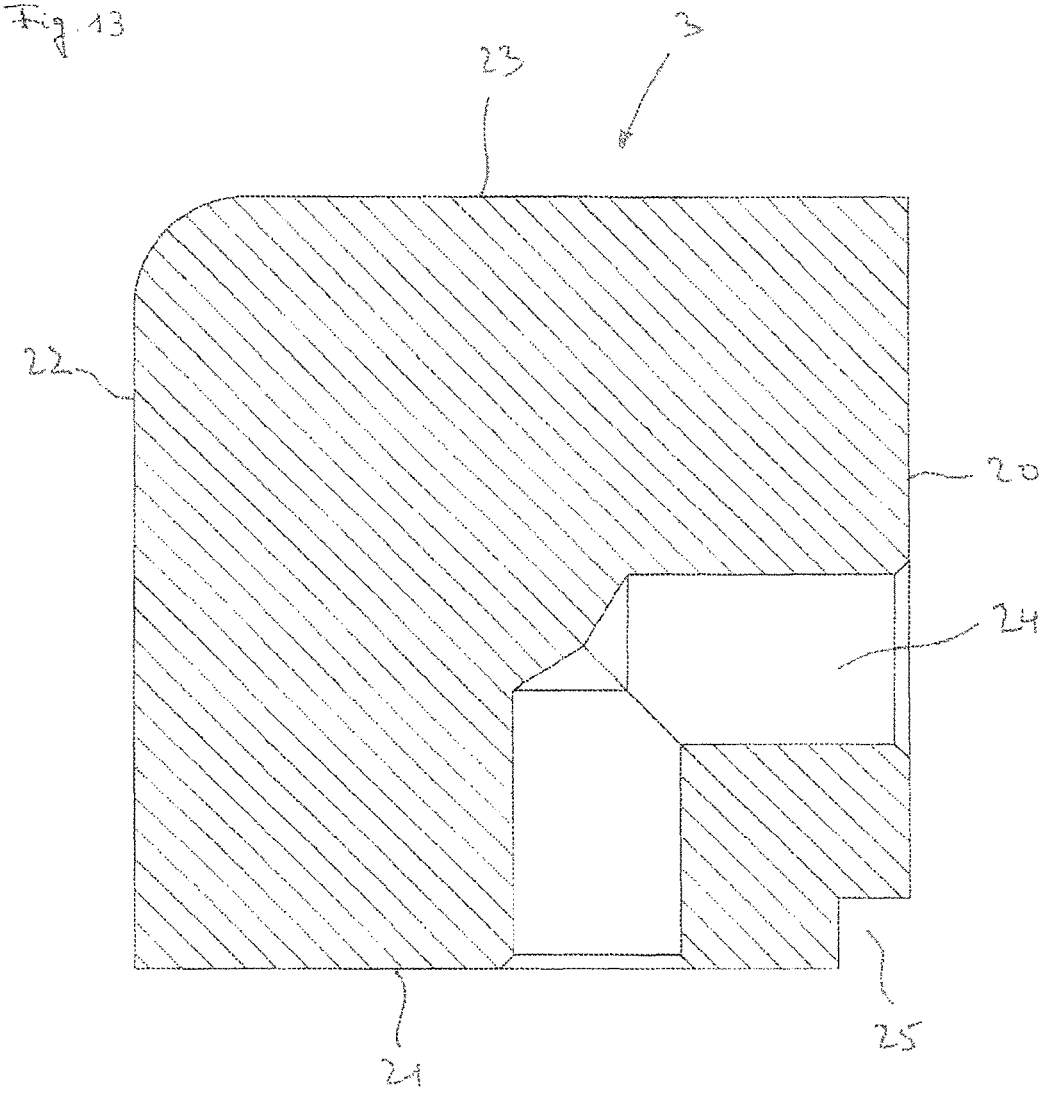
FIG. 13 shows a cutaway view along line XIII-XIII in FIG. 11.

Turning to the figures, the main components of the profile system 1 shown in FIGS. 1 and 2 consist of a plurality of elongate, identically configured profiles 2 for terminating installed tiles, comprising at least one corner connecting piece 3 and at least two connecting elements 4.

The profiles 2 for terminating installed tiles are used to terminate tile coverings laid in thin-bed mortar at the end of the covering or to terminate tile coverings in the area where the coverings meet. They thus form a visual termination of the tile coverings. In addition, they protect the front ends of the tiles against damage. In the case at hand, the profiles 2 for terminating installed tiles are each configured integrally as extruded profiles, for example as extruded profiles each two or three metres in length, and can be shortened to the desired length. The profiles 2 for terminating installed tiles are made from metal, for example from aluminium or stainless steel. Alternatively, they can also be made from plastic. As evident from FIGS. 3 to 8, the profile for terminating installed tiles has a uniform, substantially L-shaped cross-section consisting of a fastening leg 5 and a boundary leg 6 connected perpendicularly thereto. The fastening leg 5 forms a bearing surface 7 which is used to affix the profile 2 for terminating installed tiles to a substrate. The fastening leg 5 is provided with through openings 8 evenly spaced along the longitudinal extent of the fastening leg 5. In the case at hand, the boundary leg 6 is configured to be significantly thicker than the fastening leg 5. The boundary leg 6 comprises an outer longitudinal side 9 facing away from the fastening leg 5, a top side 10, an inner longitudinal side 11 arranged opposite the outer longitudinal side 9 of the boundary leg, and two front ends 12. When the profile 2 for terminating installed tiles is installed, the outer longitudinal side 9 of the boundary leg and the top side 10 of the boundary leg form visible surfaces, the inner longitudinal side 11 of the boundary leg forms a contact surface for the tiles and each of the front ends 12 of the boundary leg form contact surfaces. In the case at hand, the front ends 12 of the boundary leg are provided with a receiving opening 13 in the lower half which is substantially round, or in the case at hand is shaped in the form of an arc open on one side. The bottom side of the fastening leg 5 protrudes downwards relative to a bottom edge of the outer longitudinal side 9 of the boundary leg, thus producing a lower jointing mortar receiving area 14 for forming a joint with a predetermined visible width B in the lower area of the boundary leg 6. To enable the jointing mortar to grip, the jointing mortar receiving area 14 is provided with an undercut. The contact surface formed by the inner longitudinal side 11 of the boundary leg protrudes inwards relative to an inward-facing edge of the top side 10 of the boundary leg, thus producing an upper jointing mortar receiving area 16 for forming a joint with a predetermined visible width B in the upper area of the boundary leg 6. The upper jointing mortar receiving area 16 is also provided with an undercut 17 which allows the jointing mortar to grip. The joint widths B of the lower jointing mortar receiving area 14 and the upper jointing mortar area 16 are matched to each other in order to achieve as uniform an appearance as possible when installed.

The corner connecting piece 3 shown on an enlarged scale in FIGS. 9 to 12 is configured to visually connect the front ends 12 of the boundary legs of three profiles 2 arranged perpendicular to each other for terminating installed tiles, as shown in FIG. 1, the fastening legs 5 of which profiles are mitred in the area where they meet. The corner connecting piece 3 comprises an outer main side 18, an opposite inner main side 19 and four front ends 20, 21, 22 and 23. When installed, the outer main side 18 of the corner connecting piece forms a visible surface, the inner main side 19 of the corner connecting piece forms a contact surface for the tiles in the case at hand, each of the two adjacently arranged front ends 20 and 21 of the corner connecting piece forms a contact surface provided with a receiving recess 24, and the other two front ends 22 and 23 of the corner connecting piece form visible edges. The contours of the outer main side 18 of the corner connecting piece, of the front ends 21 and 23 of the corner connecting piece forming the visible surfaces and of the corner area connecting these front ends 22 and 23 of the corner connecting piece to the outer main side 18 of the corner connecting piece are adapted to the respective contours of the outer longitudinal sides 9 of the boundary legs and the top sides 10 of the boundary legs of the profiles 2 for terminating installed tiles connected to each other by a corner connecting piece 3 such that they are mutually aligned in a flush manner when installed. In the case at hand, the receiving recesses 24 are blind holes with a circular cross-section with a diameter identical to the diameter of the receiving openings 13 of the profiles 2 for terminating installed tiles. Each corner connecting piece 3 is configured such that when two profiles 2 for terminating installed tiles are installed, the visible joints of width B defined by the boundary legs 6 of these profiles are mutually aligned without interruption by the corner connecting piece 3. To allow for an alignment of the visible joint of the lower jointing mortar receiving area 14, the corner area of the outer main side 18 of the corner connecting piece between the two front ends 20 and 21 of the corner connecting piece forming contact surfaces is provided with a recess 25 configured as a cuboid opening, wherein the edge of the recess 25 sits flush against the bottom edge of the respective outer longitudinal sides 9 of the boundary legs of the profiles 2 for terminating installed tiles. To allow for an alignment of the visible joint of the upper jointing mortar receiving space 16, the inner main side 19 of the corner connecting piece is formed in the corner area between the two front ends 20 and 21 of the corner connecting piece forming contact surfaces by a substantially cuboid projection 26 which in the case at hand forms a termination flush with the base of the upper jointing mortar receiving area 16. The corner connecting piece 3 is preferably made from the same material as the profiles 2 for terminating installed tiles, thus creating a uniform appearance when installed.

The connecting elements 4 are preferably configured as female pins with a slit made from spring steel. The external diameter of the female pins is chosen such that the female pins can be inserted into both the receiving openings 13 and the receiving recesses 24 and can be held in place there detachably with prestress.

Figure 14:
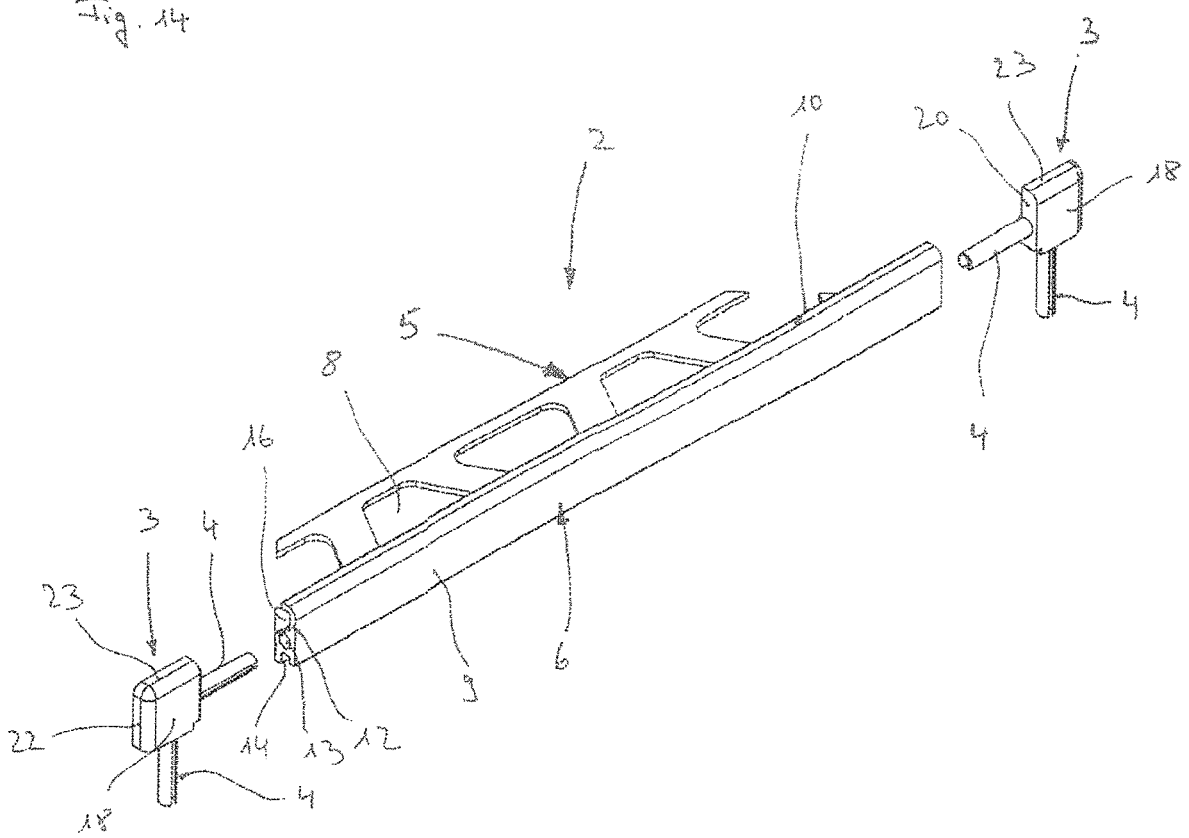
FIG. 14 shows a perspective exploded view showing a further possible arrangement of a profile for terminating installed tiles and two corner connecting pieces.

It is of course also possible to connect two further profiles 2 for terminating installed tiles to a profile 2 for terminating installed tiles using two corner connecting pieces 3 and four connecting elements 4, as indicated in FIG. 14.

Figure 16:
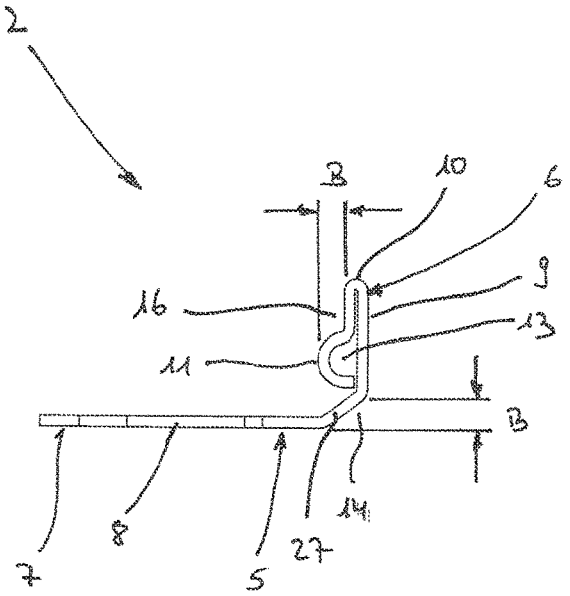
FIG. 16 shows a view of the front end of the profile for terminating installed tiles shown in FIG. 15.
Figure 15:
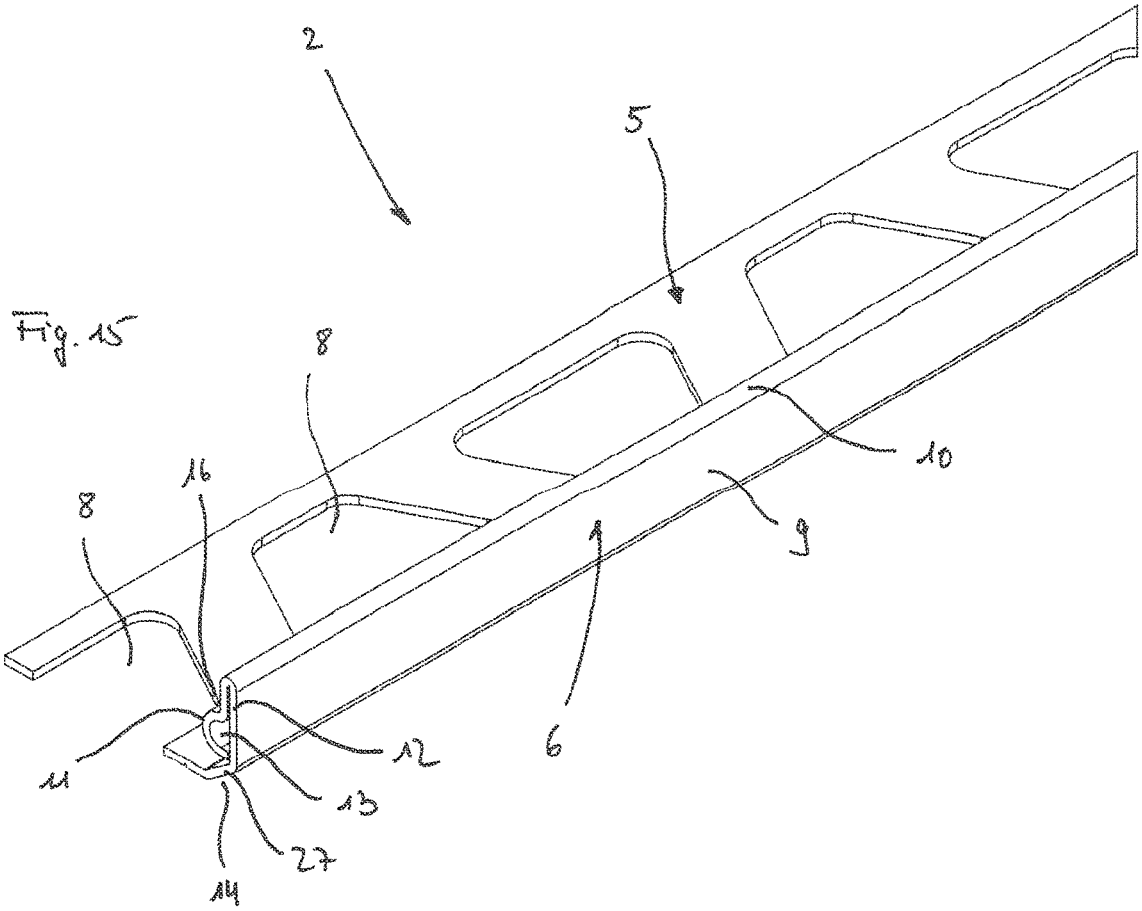
FIG. 15 shows a perspective view of a profile for terminating tiles in accordance with a second embodiment of the present technology.

FIGS. 15 and 16 show a profile 2 for terminating installed tiles in accordance with a second embodiment of the present invention which, analogously to the previously described profile for terminating installed tiles, is used to terminate tile coverings laid in thin-bed mortar at the end of the covering or to terminate tile coverings in the area where they meet. The profile 2 for terminating installed tiles firstly forms a visual termination of the tile covering and secondly protects the front ends of the tiles against damage. In the case at hand, the profile 2 for terminating installed tiles is configured as a bending profile, in other words is bent from a metal sheet, wherein the metal sheet can be made from aluminium or stainless steel, for example. Analogously to the previously described profile 2 for terminating installed tiles, the profile 2 for terminating installed tiles has a uniform, substantially L-shaped cross-section comprising a fastening leg 5 and a boundary leg 6 connected substantially perpendicularly to the fastening leg. The fastening leg 5 forms a bearing surface 7 and is provided with through openings 8 evenly spaced along the longitudinal extent of the fastening leg 5. The boundary leg comprises an outer longitudinal side 9 facing away from the fastening leg, a top side 10, an inner longitudinal side 11 arranged opposite the outer longitudinal side 9 of the boundary leg, and two front ends 12, wherein the top side 10 of the boundary leg is formed by a bending area in which the initial sheet is bent by 180° in the case at hand. When the profile 2 for terminating installed tiles is installed, the outer longitudinal side 9 of the boundary leg and the top side 10 of the boundary leg form visible surfaces, the inner longitudinal side 11 of the boundary leg forms a contact surface for the tiles and each of the front ends 12 of the boundary leg form contact surfaces. The front ends 12 of the boundary leg are provided with a receiving opening 13 which is formed by bending the exposed end area of the inner longitudinal side 11 in a semi-circle shape so that the exposed end of the inner longitudinal side 11 of the boundary leg is facing the outer longitudinal side 9 of the boundary leg. In the case at hand, the fastening leg 5 and boundary leg 6 are connected to each other via a transition leg 27 such that the bottom side of the fastening leg 5 protrudes downwards relative to a lower edge of the outer longitudinal side 9 of the boundary leg, thus producing a lower jointing mortar area 14 along the transition leg 27 for forming a joint with a predetermined visible width B in the lower area of the boundary leg 6. The contact surface formed by the inner longitudinal side 11 of the boundary leg protrudes inwards relative to an inward-facing edge of the top side 10 of the boundary leg, thus producing an upper jointing mortar area 16 for forming a joint with a predetermined visible width B in the upper area of the boundary leg 6. In the case at hand, the joint widths B of the lower jointing mortar receiving area 14 and upper jointing mortar receiving area 16 are matched to each other, in order to achieve as uniform an appearance as possible when installed. Analogously to the receiving opening 13 of the profile 2 for terminating installed tiles which was previously described, the receiving opening 13 is used to receive in a clamping manner a connecting element 4 configured in particular in the form of a pin, in order to connect the profile 2 for terminating installed tiles either to a further profile 2 for terminating installed tiles or to a corner connecting piece 3. The corner connecting piece 3 is essentially identical to the corner connecting piece 3 shown in FIGS. 9 to 13, wherein the shape and dimensions of the corner connecting piece 3 are adapted accordingly to the shape and dimensions of the front end of the boundary leg 6 of the profile 2 for terminating installed tiles.

Figure 17:
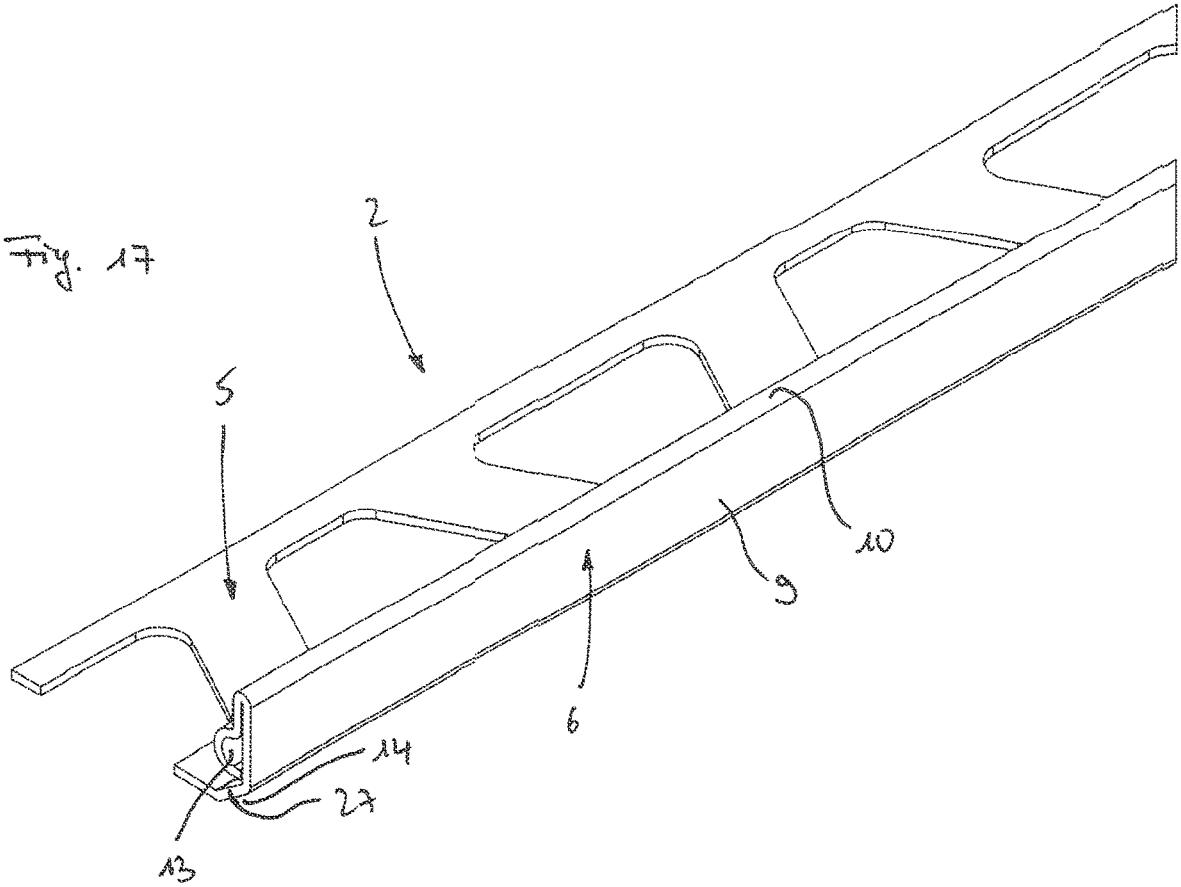
FIG. 17 shows a perspective view of a profile for terminating tiles in accordance with a third embodiment of the present technology.
Figure 18:
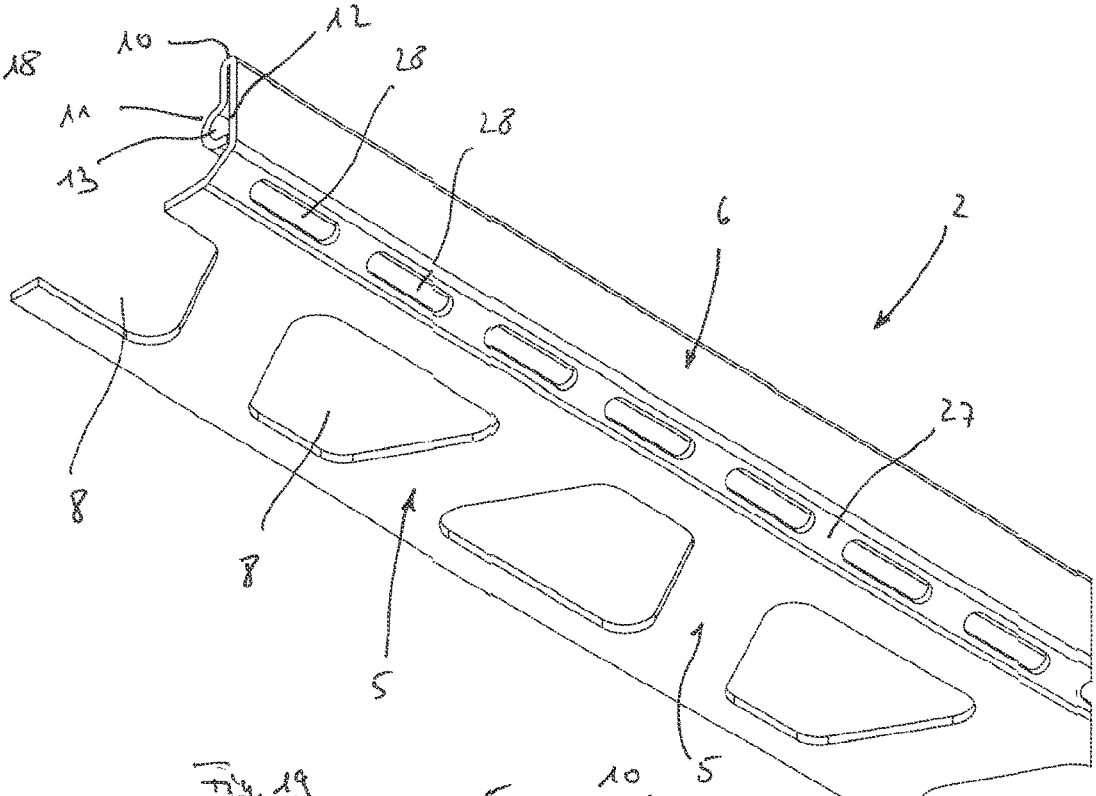
FIG. 18 shows a further perspective view of the profile for terminating installed tiles shown in FIG. 17.
Figure 19:
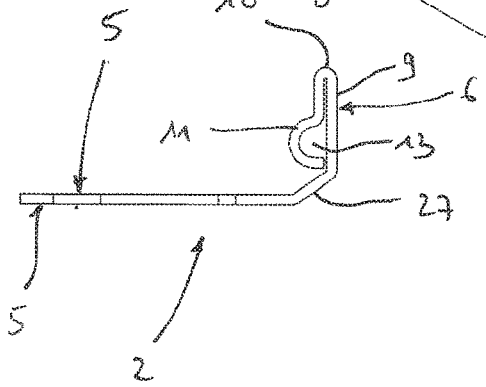
FIG. 19 shows a view of the front end of the profile for terminating installed tiles shown in FIGS. 17 and 18.

FIGS. 17 to 18 show a profile 2 for terminating installed tiles in accordance with a third embodiment of the present invention which is configured broadly analogously to the profile 2 for terminating installed tiles in accordance with the second embodiment of the present invention. The only difference consists in the fact that the transition leg 27 is provided with elongate slits 28 extending through the transition leg 27. These slits 28 receive jointing mortar added to the lower jointing mortar receiving area 14 so that this mortar can grip to the inside of the transition leg 27.

Figure 20:
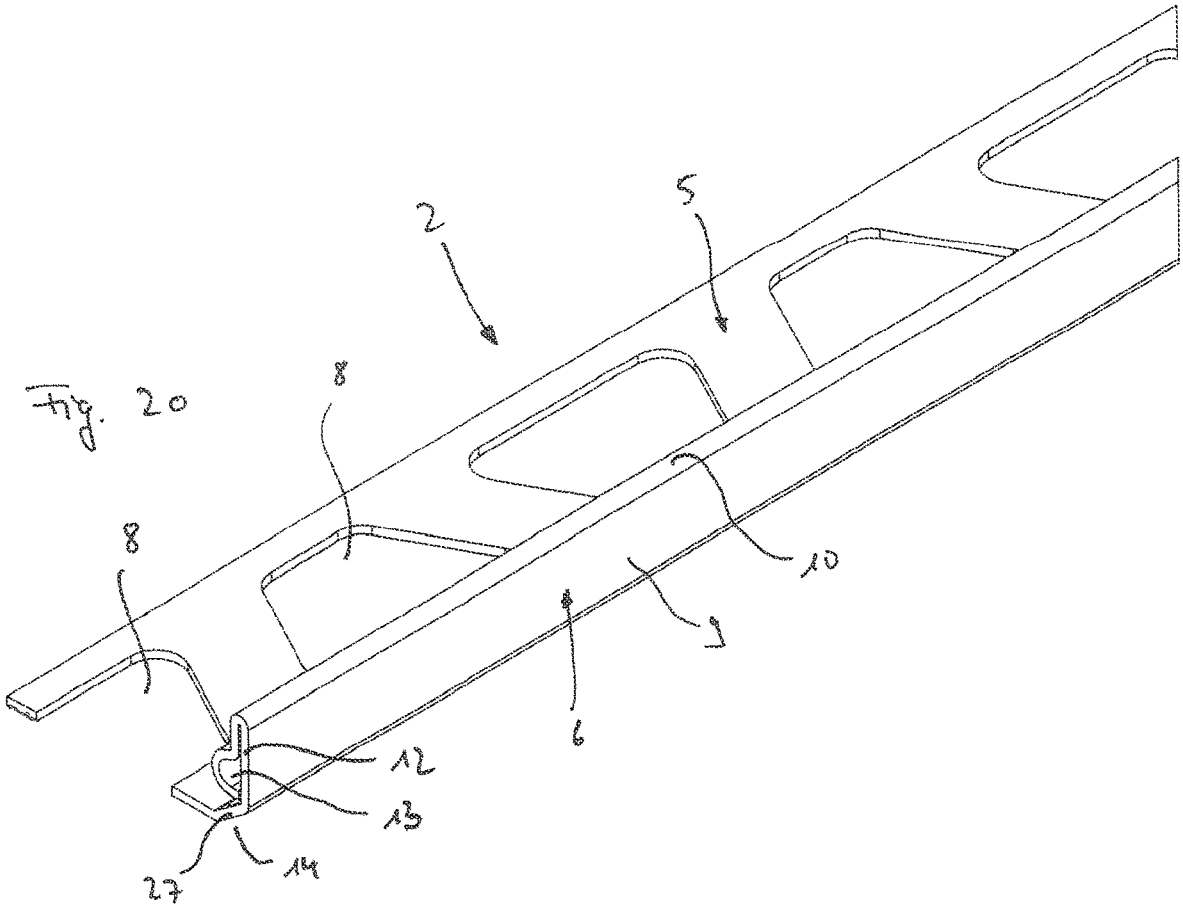
FIG. 20 shows a perspective view of a profile for terminating tiles in accordance with a fourth embodiment of the present technology.
Figure 21:
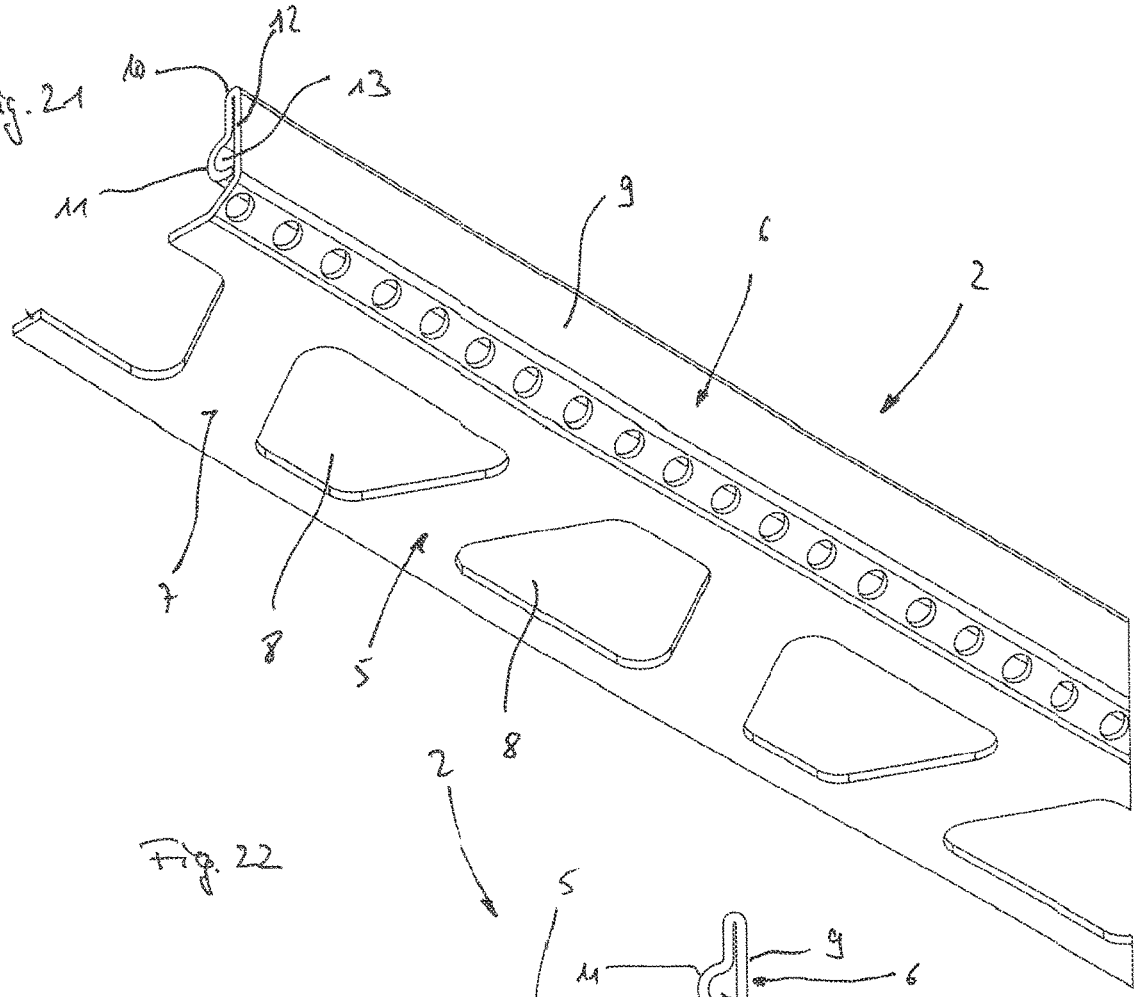
FIG. 21 shows a further perspective view of the profile for terminating installed tiles shown in FIG. 20.
Figure 22:
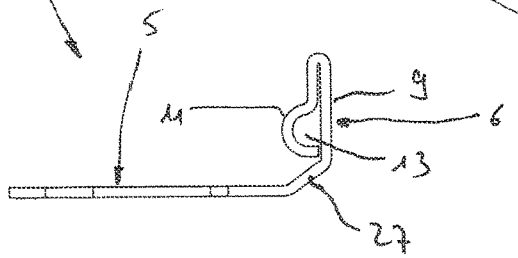
FIG. 22 shows a view of the front end of the profile for terminating installed tiles shown in FIGS. 20 and 21.

FIGS. 20 and 21 show a profile 2 in accordance with a fourth embodiment which differs from the profile 2 for terminating installed tiles in accordance with the third embodiment only in the fact that round through openings 29 are provided in the transition leg 27 instead of slits 28.

Figure 24:
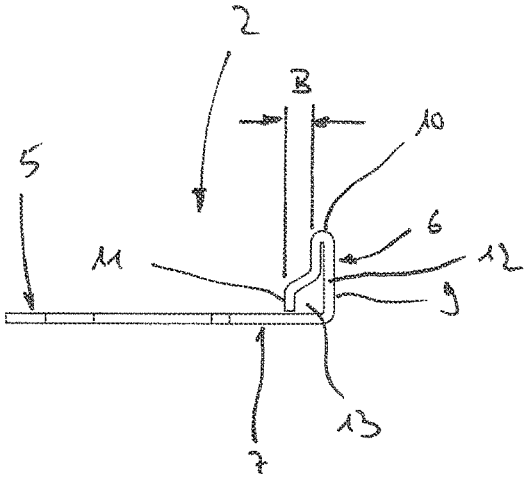
FIG. 24 shows a view of the front end of the profile for terminating installed tiles shown in FIG. 23.
Figure 23:
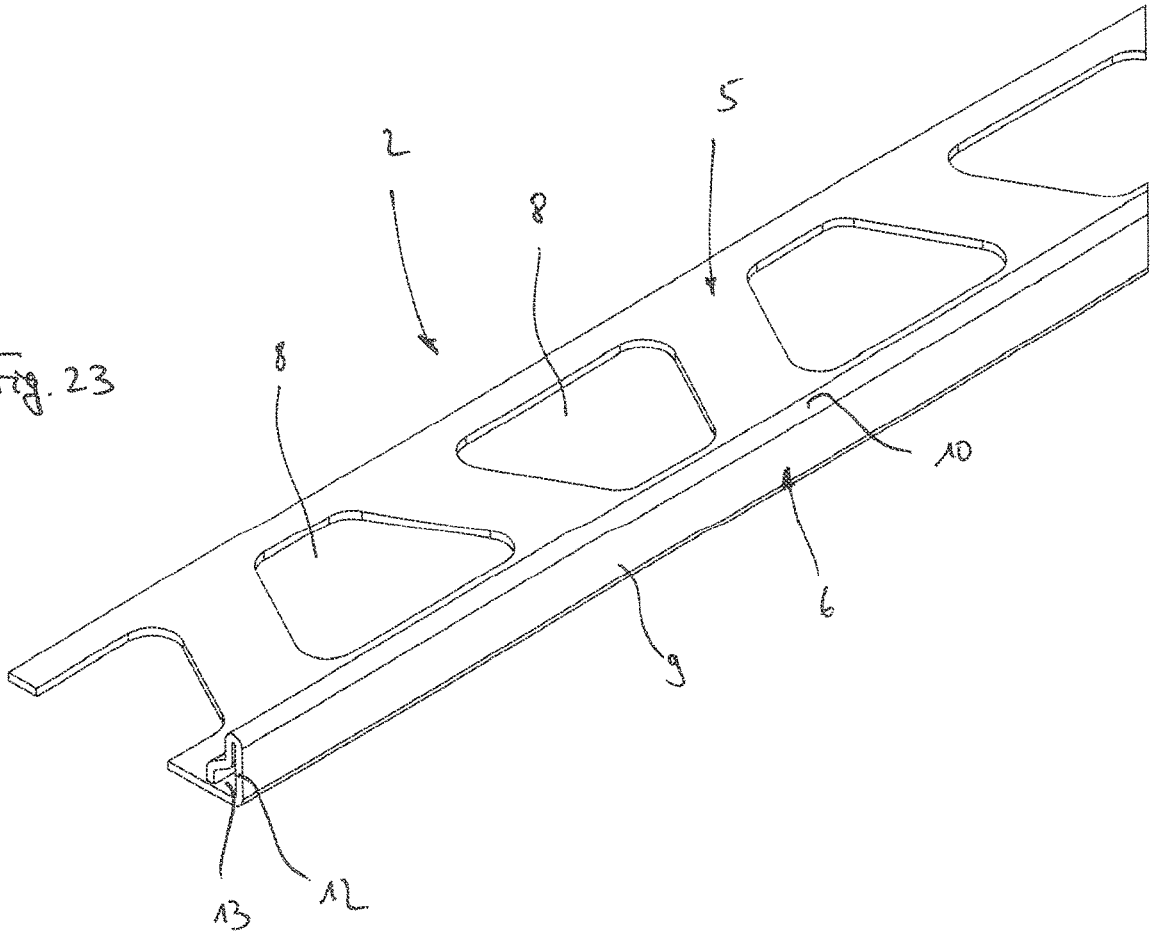
FIG. 23 shows a perspective view of a profile for terminating tiles in accordance with a fifth embodiment of the present technology.

FIGS. 23 and 24 show a profile 2 for terminating installed tiles in accordance with a fifth embodiment of the present invention which is broadly identical to the profile 2 for terminating installed tiles in accordance with the second embodiment. A first difference consists in that no transition leg 27 is provided between the fastening leg 5 and boundary leg 6. Instead, there is a direct transition between the fastening leg 5 and boundary leg 6, which are arranged at right angles to each other. The profile for terminating installed tiles shown in FIGS. 23 and 24 accordingly does not have a lower jointing mortar area 14. A further difference consists in that the exposed end section of the inner longitudinal side 11 of the boundary leg is not bent in a semi-circle shape. In the present case, the exposed end section of the inner longitudinal side 11 of the boundary leg is bent first obliquely outwards away from the outer longitudinal side 9 of the boundary leg towards the fastening leg 5 and then downwards again towards the fastening leg 5 so that it is substantially perpendicular to the fastening leg, in order to create the receiving opening 13 which in the case at hand has a pentagonal cross-section. The corner connecting piece 3 for the profile 2 for terminating installed tiles shown in FIGS. 23 and 24 is essentially identical to the corner connecting piece 3 shown in FIGS. 9 to 13, wherein the shape and dimensions of the corner connecting piece 3 are adapted accordingly to the shape and dimensions of the front end of the boundary leg 6 of the profile 2 for terminating installed tiles. However, no recess 25 is provided due to the absence of any lower jointing mortar area 14.

Figure 26:
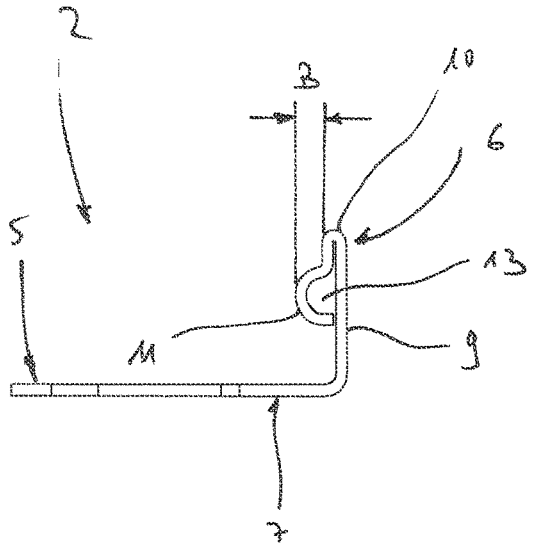
FIG. 26 shows a view of the front end of the profile for terminating installed tiles shown in FIG. 25.
Figure 25:
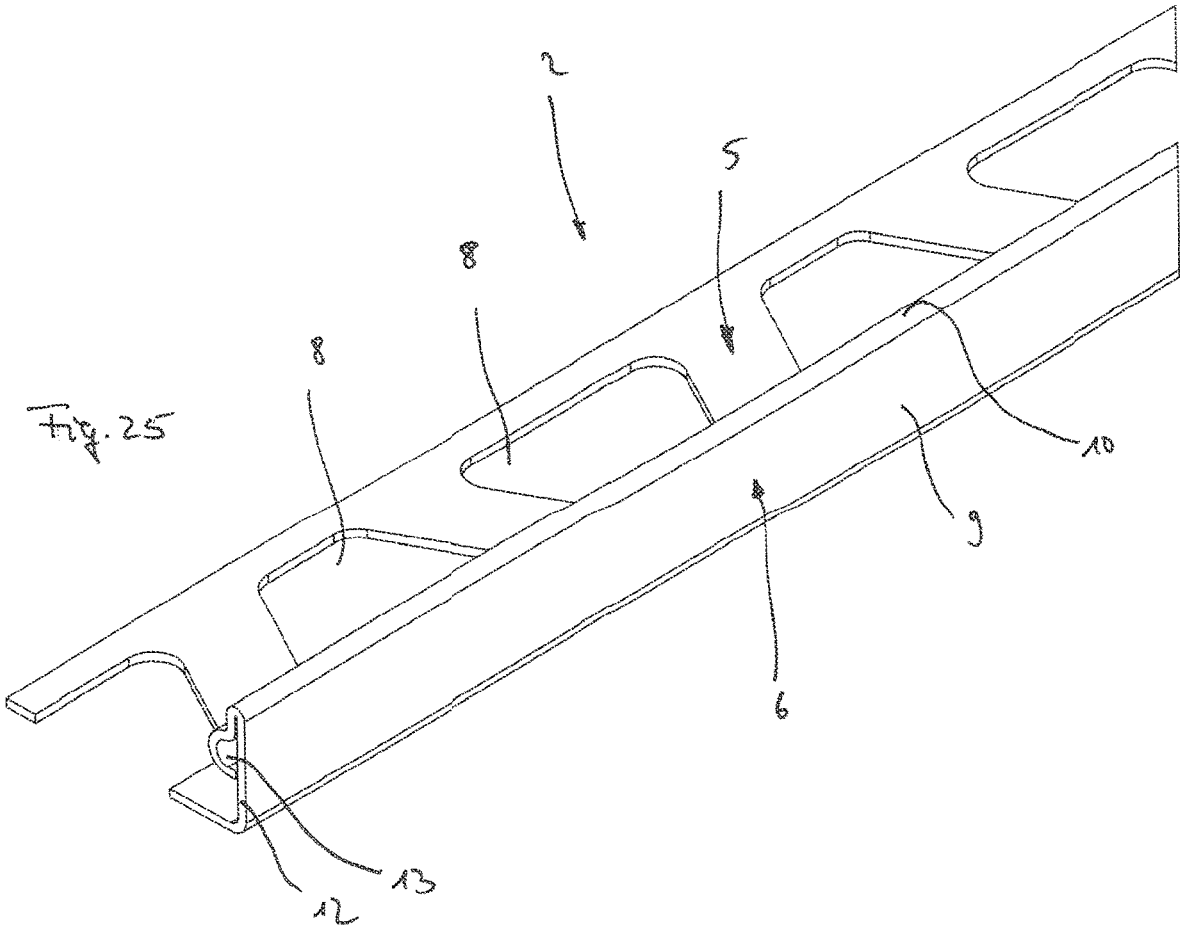
FIG. 25 shows a perspective view of a profile for terminating tiles in accordance with a sixth embodiment of the present technology.

FIGS. 25 and 26 show a profile 2 for terminating installed tiles in accordance with a sixth embodiment of the present invention, which is broadly identical to the profile 2 for terminating installed tiles in accordance with the second embodiment of the present invention. The only difference consists in the fact that the profile 2 for terminating installed tiles in accordance with the sixth embodiment does not have a transition leg 27. Instead, there is a direct transition between the fastening leg 5 and boundary leg 6, which in the case at hand extend perpendicularly to each other. The profile for terminating installed tiles shown in FIGS. 25 and 26 accordingly does not have a lower jointing mortar area 14 and the associated corner connecting piece 3 is configured without a recess 25.

Figure 28:
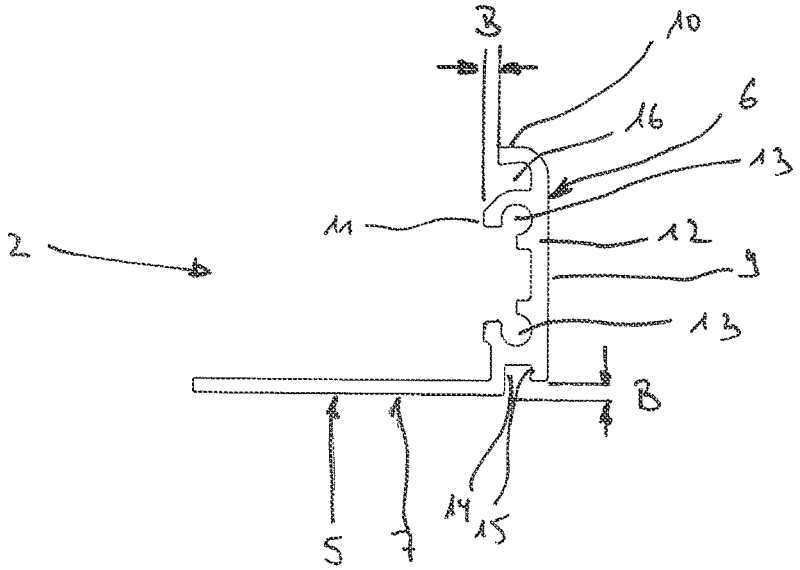
FIG. 28 shows a view of the front end of the profile for terminating installed tiles shown in FIG. 27.
Figure 27:
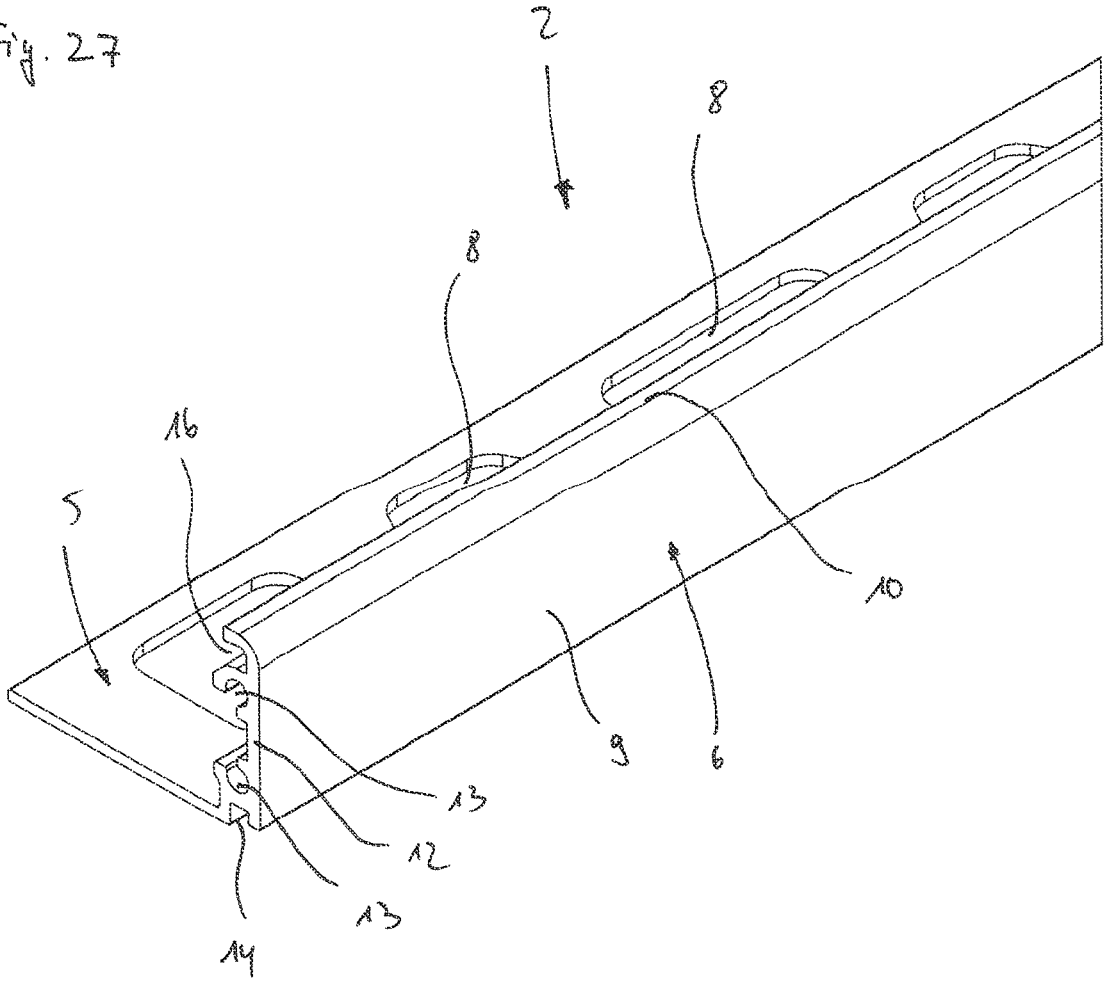
FIG. 27 shows a perspective view of a profile for terminating tiles in accordance with a seventh embodiment of the present technology.

FIGS. 27 and 28 show a profile 2 for terminating installed tiles in accordance with a seventh embodiment of the present invention, which is broadly identical to the profile 2 for terminating installed tiles in accordance with the first embodiment of the present invention. The only difference consists in the fact that the front end 12 of the boundary leg is provided with two receiving openings 13 which are positioned at a distance from each other. An associated corner connecting piece is also accordingly provided with two correspondingly positioned receiving recesses 24 on the corresponding front ends 20 of the corner connecting piece, allowing profiles 2 for terminating installed tiles to be fastened to each other or to corner connecting pieces 3, in each case using two connecting elements 4. Firstly, this achieves a more stable fastening. Secondly, it also prevents relative rotation of the components connected to each other.

It will be recognized that embodiments of profile systems in accordance with the invention are not limited to the above-described embodiments, and various modifications may be possible without departing from the scope of the invention as defined in the appended claims.

REFERENCE NUMBERS

1 Profile system
2 Profile for terminating installed tiles
3 Corner connecting piece
4 Connecting element
5 Fastening leg
6 Boundary leg
7 Bearing surface
8 Through opening
9 Outer longitudinal side of the boundary leg
10 Top side of the boundary leg
11 Inner longitudinal side of the boundary leg
12 Front end of the boundary leg
13 Receiving opening
14 Lower jointing mortar receiving area
15 Undercut
16 Upper jointing mortar receiving area
17 Undercut
18 Outer main side of the corner connecting piece
19 Inner main side of the corner connecting piece
20 Front end of the corner connecting piece
21 Front end of the corner connecting piece
22 Front end of the corner connecting piece
23 Front end of the corner connecting piece
24 Receiving recess
25 Recess
26 Projection
27 Transition leg
28 Slit
29 Through opening
B Visible joint width

I claim:

1. A profile system (1) comprising at least two elongate profiles (2) for terminating installed tiles, the elongate profiles including a uniform, substantially L-shaped cross-section comprising a fastening leg (5) for fastening to a substrate and forming a bearing surface (7) provided with through openings (8), and comprising an adjoining, substantially perpendicular, boundary leg (6), wherein the outer longitudinal side (9) of the boundary leg facing away from the fastening leg (5) and the top side (10) of the boundary leg form visible surfaces, the inner longitudinal side (11) of the boundary leg facing towards the fastening leg (5) forms a contact surface for the tiles and each of the front ends (12) of the boundary leg forms a contact surface provided with a receiving opening (13) for receiving a connecting element (4), at least one corner connecting piece (3) which is configured to visually connect to the boundary legs (6) the front ends (12) of the boundary legs of three profiles (2) arranged perpendicular to each other for terminating installed tiles, the corner connecting pieces including an outer main side (18) which forms a visible surface, an inner main side (19) which forms a contact surface for the tiles, and two adjacently arranged front ends (20, 21), each of which forms a contact surface provided with a receiving recess (24) for receiving a connecting element, and two further front ends (22, 23) which form visible edges, wherein the contours of the outer main side (18) of the corner connecting piece, that of the front ends (22, 23) of the corner piece forming the visible surfaces and that of the corner area connecting these front ends (22, 23) of the corner piece and the main side (18) of the corner connecting piece to each other are adapted to the respective contours of the outer longitudinal sides (9) of the boundary leg and the top sides (10) of the boundary legs of the three profiles for terminating installed tiles connected to each other via a corner connecting piece (3) such that the profiles are mutually aligned in a flush manner when installed, and at least two connecting elements (4), which are configured so that one exposed end is inserted into the receiving opening (13) of one of the at least two elongate profiles (2) for terminating installed tiles and an other exposed end is inserted into the receiving recess (24) of a corner connecting piece (3).

2. The profile system (1) according to claim 1, wherein the at least two profiles (2) for terminating installed tiles are configured integrally and are made from metal or plastic.

3. The profile system (1) according to claim 1, wherein the at least two profiles (2) for terminating installed tiles are configured as extruded profiles or as bending profiles.

4. The profile system (1) according to claim 1, wherein the receiving openings (13) are at least partially configured in the shape of a curve or arc.

5. The profile system (1) according to claim 1, wherein the bottom side of the fastening leg (5) protrudes downwards relative to a lower edge of the outer longitudinal side (9) of the boundary leg, thus producing a lower jointing mortar receiving area (14) for creating a joint with a predetermined visible joint width (B) in the lower area of the boundary leg (6), wherein the jointing mortar receiving area (14) is provided with an undercut (15).

6. The profile system (1) according to claim 1, wherein the contact surface formed by the inner longitudinal side (11) of the boundary leg of each of the at least two elongate profiles (2) protrudes inwards relative to an inward-facing edge of the top side (10) of the boundary leg, thus producing an upper jointing mortar receiving area (16) for creating a joint with a predetermined visible joint width (B) in the upper area of the boundary leg (6), wherein the jointing mortar receiving area (16) is provided with an undercut (17).

7. The profile system (1) according to claim 6, wherein the visible joint widths (B) formed by each of the at least two elongate profiles (2) are matched to each other.

8. The profile system (1) according to claim 7, wherein each corner connecting piece (3) is configured such that, when the at least two elongate profiles (2) for terminating installed tiles are installed, the visible joints defined by the boundary legs (6) of these profiles are mutually aligned without interruption by the corner connecting piece (3).

9. The profile system (1) according to claim 1, wherein the corner connecting pieces (3) are made from the same material as the at least two elongate profiles (2) for terminating installed tiles.

10. The profile system (1) according to claim 1, wherein the connecting elements (4) are configured as female pins with a slit.

11. The profile system (1) according to claim 10, wherein the connecting elements (4) are made from spring steel.

12. A profile system (1) comprising elongate profiles (2) for terminating installed tiles with a uniform, substantially L-shaped cross-section comprising a fastening leg (5) for fastening to a substrate and forming a bearing surface (7) provided with through openings (8), and comprising an adjoining, substantially perpendicular, boundary leg (6) having a front end (12), wherein the outer longitudinal side (9) of the boundary leg facing away from the fastening leg (5) and the top side (10) of the boundary leg form visible surfaces, the boundary leg provided with a receiving opening (13) for receiving a connecting element (4);

at least one corner connecting piece (3) which is configured to visually connect the front ends (12) of the boundary legs of three profiles (2) arranged perpendicular to each other for terminating installed tiles, the at least one corner connecting piece provided with a receiving recess (24) for receiving a connecting element, and at least two connecting elements (4), which are configured so that one exposed end is inserted into the receiving opening (13) of a profile (2) for terminating installed tiles and an other exposed end is inserted into the receiving recess (24) of a corner connecting piece (3).

13. The profile system (1) according to claim 12, wherein the corner connecting pieces (3) are made from the same material as the profiles (2) for terminating installed tiles.

14. The profile system (1) according to claim 12, wherein the connecting elements (4) are configured as female pins with a slit.

* * * * *